US007794361B2

(12) United States Patent
Wang

(10) Patent No.: US 7,794,361 B2
(45) Date of Patent: Sep. 14, 2010

(54) SWING HANDLE ARRANGEMENT FOR AN EXERCISE EQUIPMENT

(76) Inventor: Leao Wang, No. 1, Lane 233, Sec. 2, Charng Long Rd., Taiping (TW) 411

( * ) Notice: Subject to any disclaimer, the term of this patent is extended or adjusted under 35 U.S.C. 154(b) by 0 days.

(21) Appl. No.: 12/348,914

(22) Filed: Jan. 6, 2009

(65) Prior Publication Data

US 2010/0173753 A1 Jul. 8, 2010

(51) Int. Cl.
*A63B 22/00* (2006.01)

(52) U.S. Cl. ..... 482/51; 482/52; 482/62

(58) Field of Classification Search ..... 482/51, 482/52, 57, 62

See application file for complete search history.

(56) References Cited

U.S. PATENT DOCUMENTS 4,708,128 A * 11/1987 Ancillotti ..... 601/36
6,132,339 A * 10/2000 Wang et al. ..... 482/53
6,544,146 B1 * 4/2003 Stearns et al. ..... 482/52
6,672,992 B1 * 1/2004 Lo et al. ..... 482/52
7,267,638 B2 * 9/2007 Wang ..... 482/52
2005/0209057 A1 * 9/2005 Wang et al. ..... 482/52
2005/0227824 A1 * 10/2005 Wu et al. ..... 482/62

* cited by examiner

*Primary Examiner*—Fenn C Mathew
*Assistant Examiner*—Andrew M Tecco

(57) ABSTRACT

A swing handle arrangement for an exercise equipment having a pair of drive rods driven by the pedal rods such that longitudinal drive gears fixed at the drive rods are cooperated with swing handles having the lateral drive gears for conducting a swing action. In this way, a waist-twisting movement of the upper body can be synchronically achieved when the operator holds the swing handles to take exercise at his feet of the lower body.

4 Claims, 7 Drawing Sheets

SWING HANDLE ARRANGEMENT FOR AN EXERCISE EQUIPMENT

BACKGROUND OF THE INVENTION

1. Fields of the Invention

The invention relates to a swing handle arrangement for an exercise equipment, and more particularly, to a structure through which a leg movement of the lower body and a waist-twisting movement of the upper body can be synchronically achieved.

2. Description of the Related Art

As well-known, the fitness apparatus used for training the legs, such as fitness bike, treadmills or elliptical cross trainers, etc. is provided with structure on which the operator's feet stand. Some of the above-mentioned apparatuses include additional coupled handles on which both hands of the operator hold. However, they can be held by both hand of the operator only for conducting a forward and backward swing action that simulates the movement of the extremities when people walk or run. In other words, the upper body of the operator such as abdominal muscle can not be trained at the same time.

In order to resolve the above-mentioned problem, another structure disclosed in US pat. application Ser. No. 2006/0293153 aims to achieve a synchronic stretching-forward effect of both hands (like the boxing action in the boxing game) when both feet of the operators conducts a treading movement.

The stretching-forward action of the upper limbs may achieve the training effect of the arm strength. However, it is not beneficial to the waist and abdominal muscles of the operator. When the operator requires the training of his waist and abdominal muscles, another fitness apparatuses must be used to fulfill his personal needs. As a result, the conventional apparatus requires further improvement.

SUMMARY OF THE INVENTION

A primary object of the invention is to provide a swing handle arrangement for an exercise equipment that achieves the effect of training the legs at the lower body and the effect of twisting the waist and abdominal muscles of the upper body of the operator only by use of a single exercise equipment through a synchronic coupled and swing movement of his upper and lower body. In this way, an overall training and fitness effect is achieved, thereby increasing the application value and the body-building effect.

According to the invention, a swing handle arrangement for an exercise equipment includes a pair of drive rods driven by the pedal rods such that longitudinal drive gears fixed at the drive rods are cooperated with swing handles having the lateral drive gears for conducting a swing action. In this way, a waist-twisting movement of the upper body can be synchronically achieved when the operator holds the swing handles to take exercise at his feet of the lower body.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

The present invention will now be described in more detail hereinafter with reference to the accompanying drawings that show various embodiments of the invention.

Figure 1:
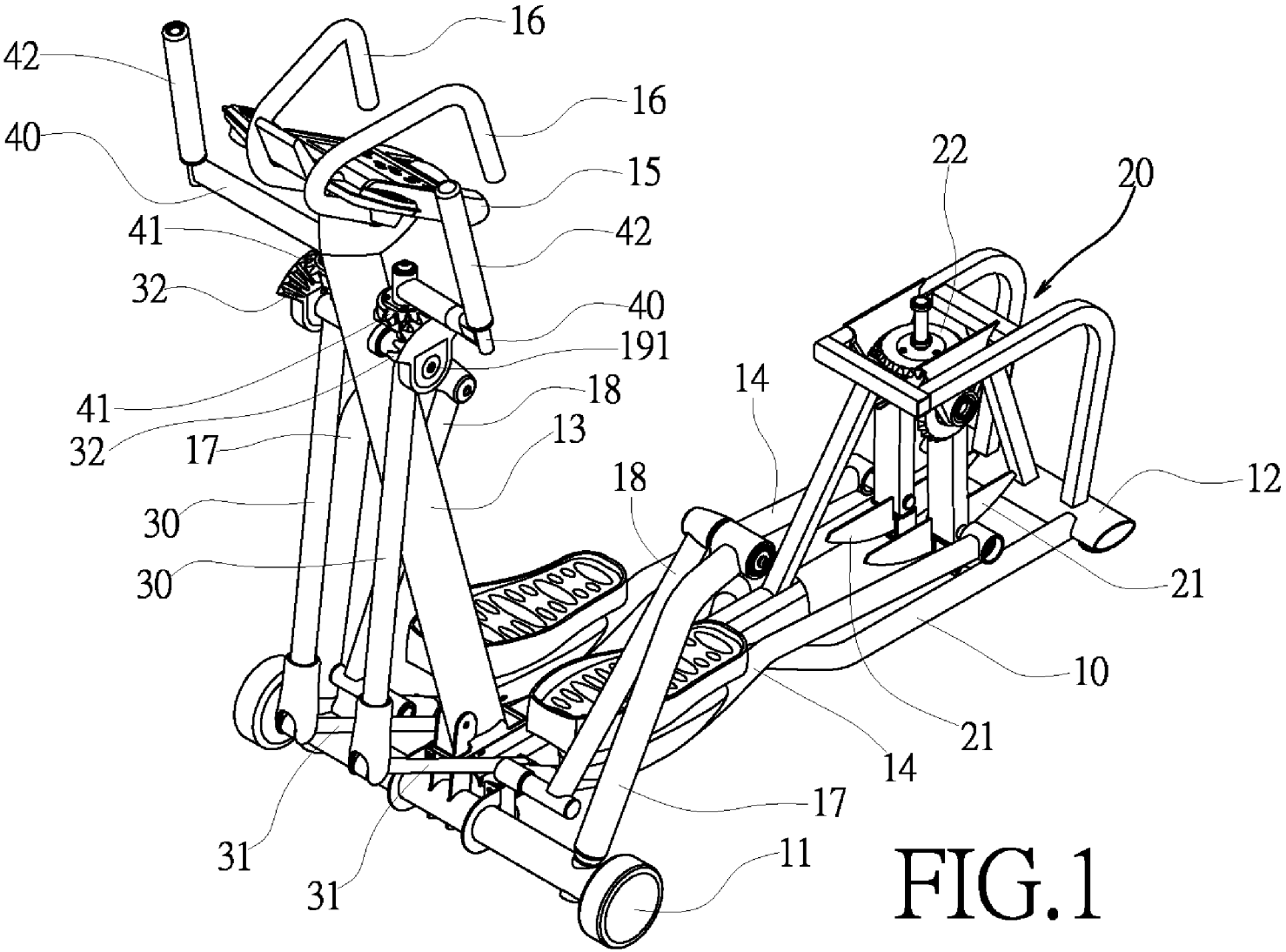
FIG. 1 is a perspective view of a preferred embodiment of the invention.
Figure 2:
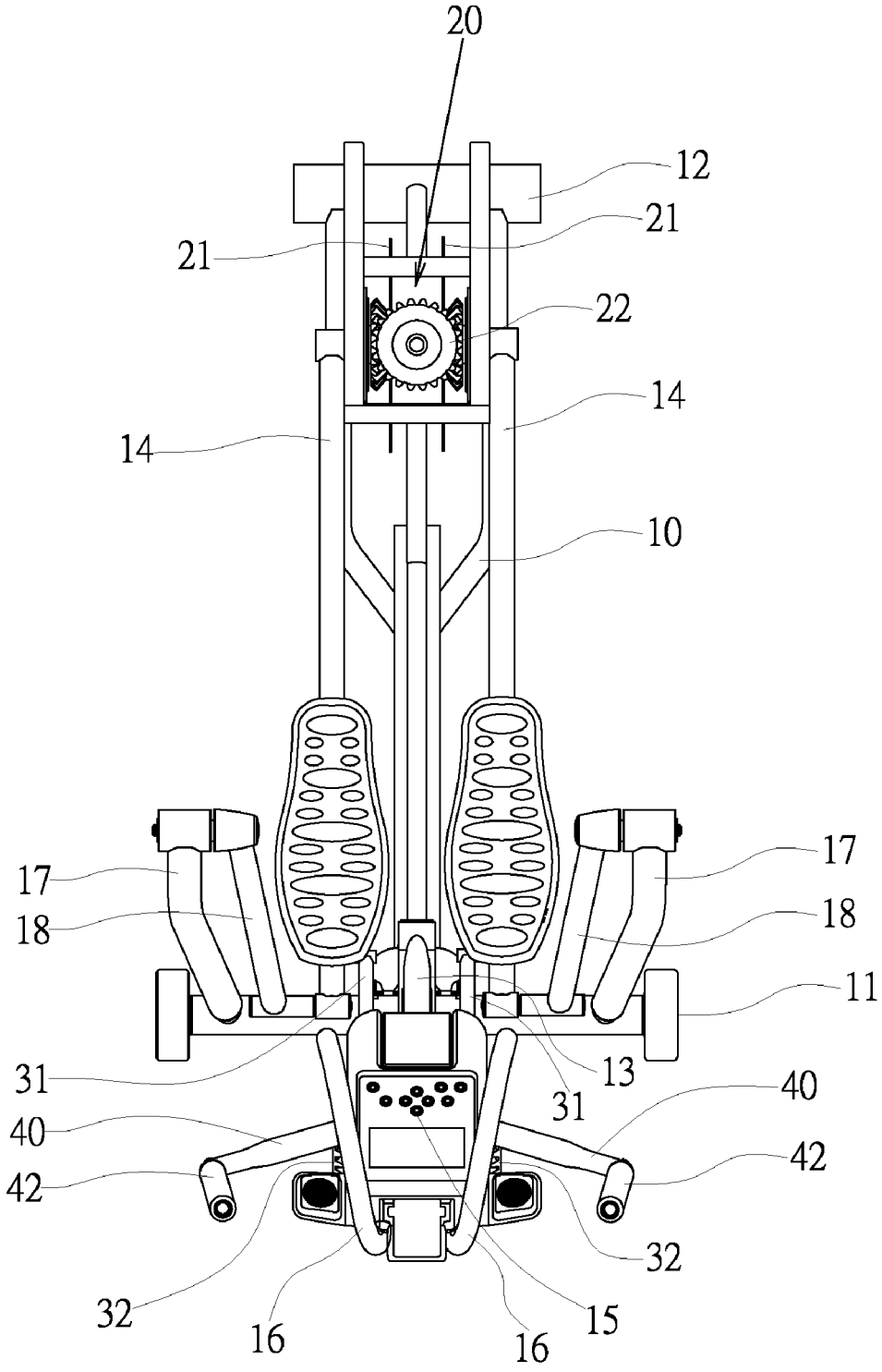
FIG. 2 is a top view of the preferred embodiment of the invention according to FIG. 1.
Figure 3:
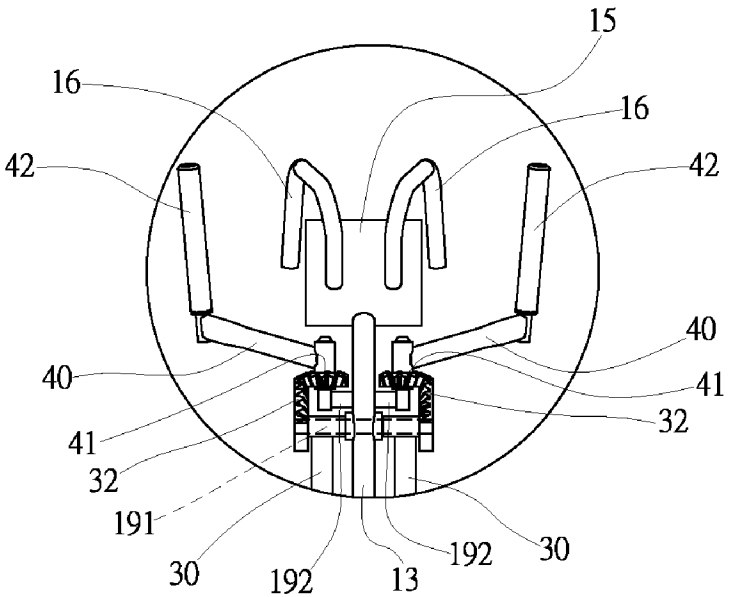
FIG. 3 is a schematic drawing of the partial structure of the preferred embodiment of the invention according to FIG. 1.
Figure 4:
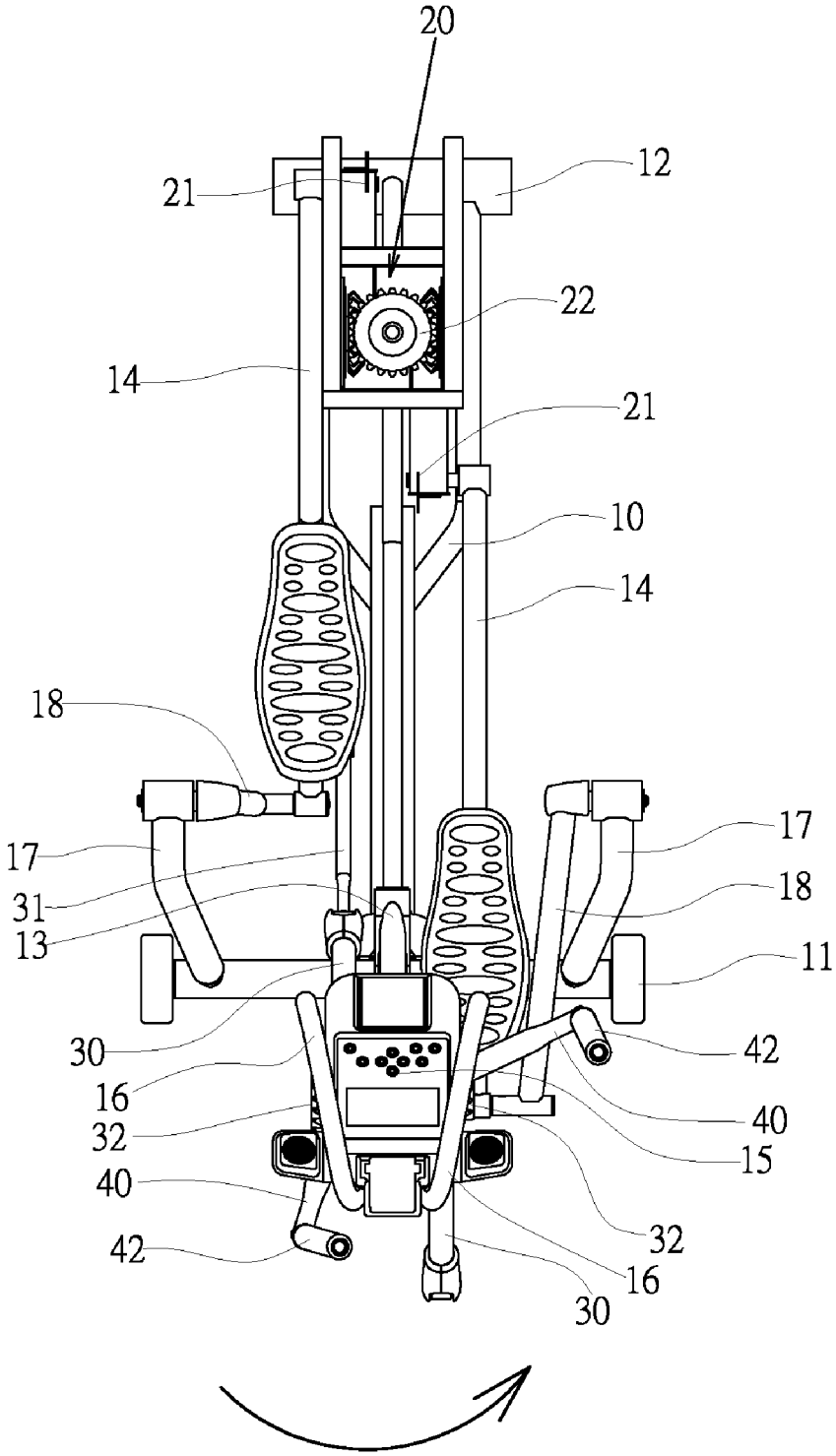
FIG. 4 is a top view of the preferred embodiment of the invention according to FIG. 2 wherein the operation thereof is illustrated.
Figure 5:
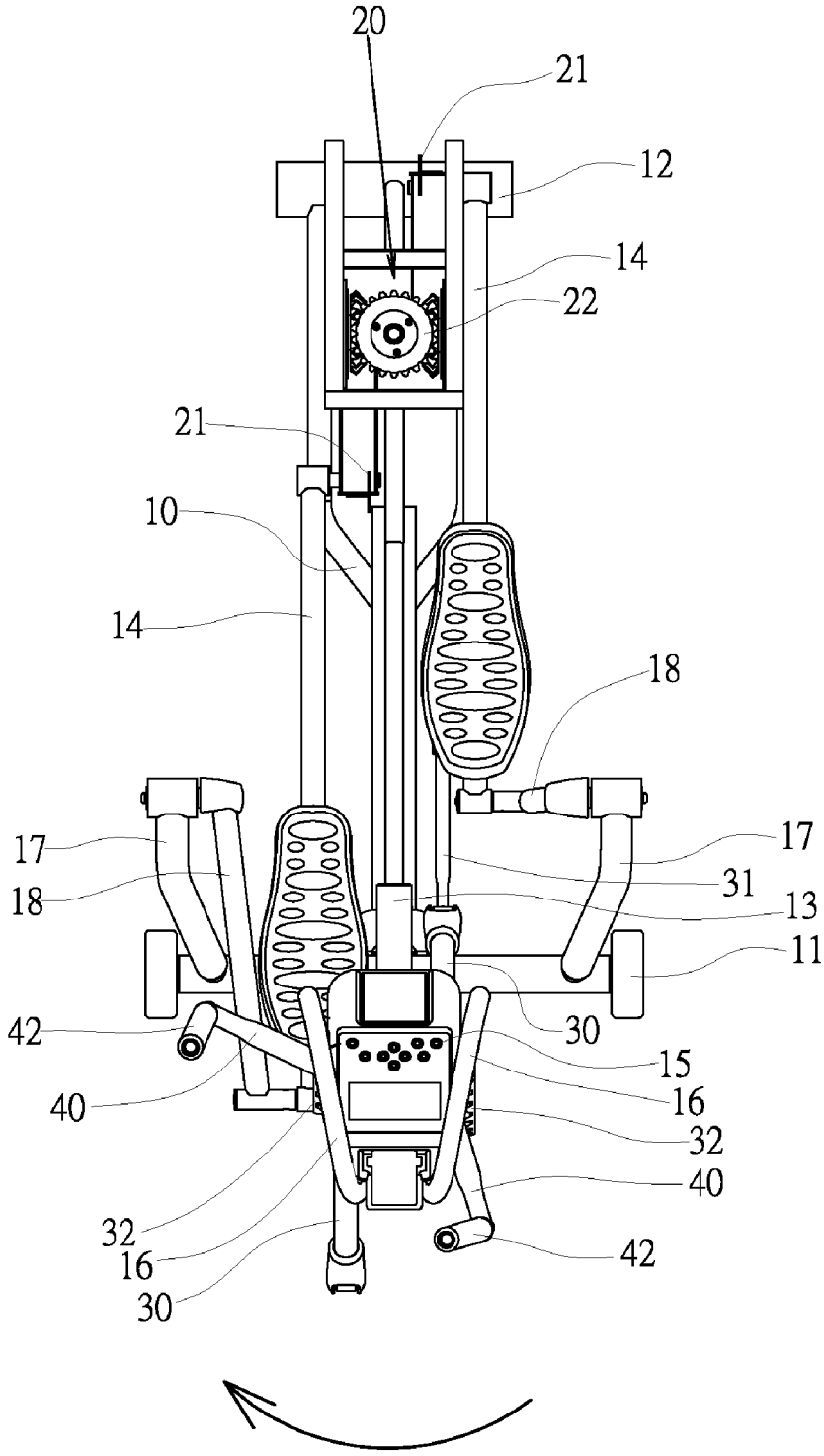
FIG. 5 is a top view of the preferred embodiment of the invention according to FIG. 2 wherein a continuous operation thereof is illustrated.
Figure 6:
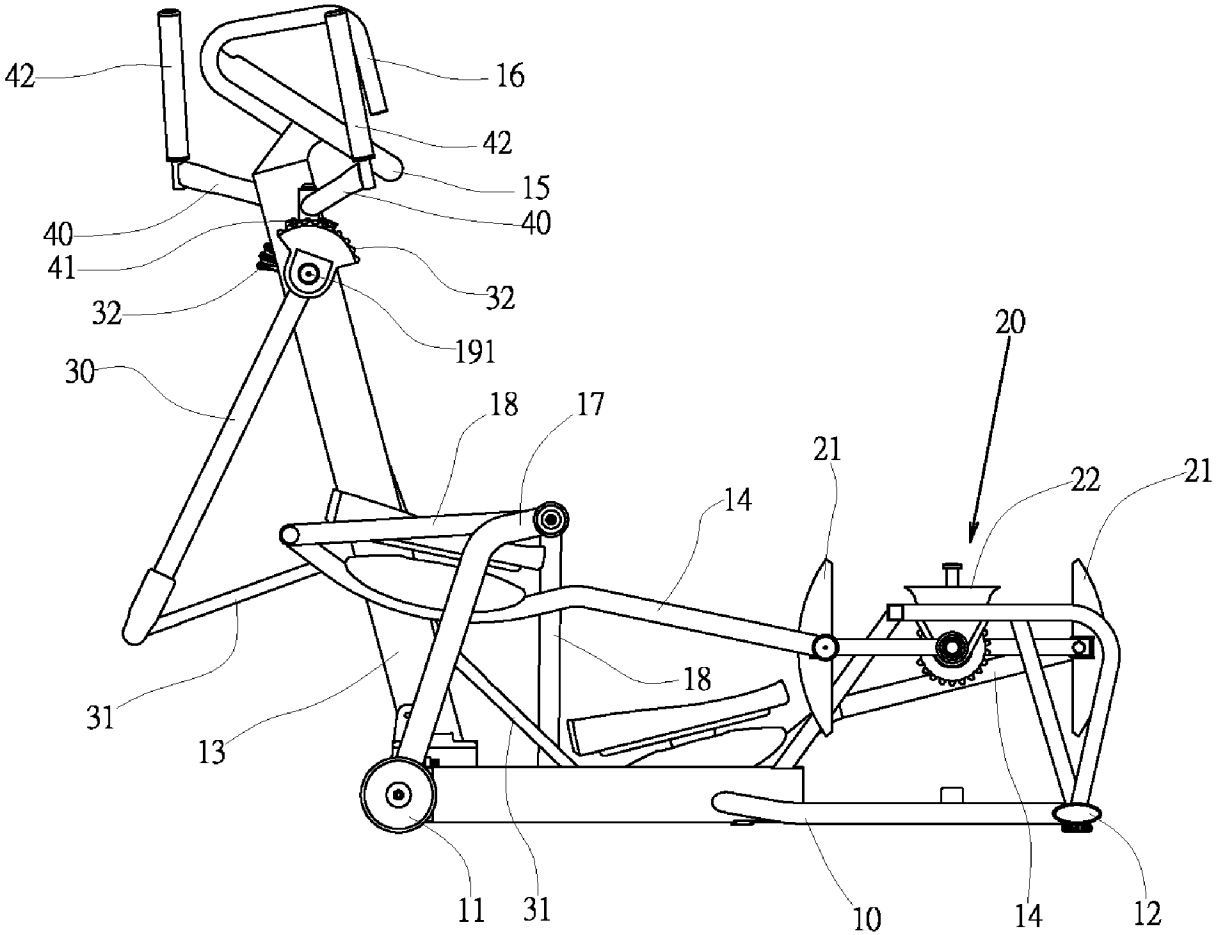
FIG. 6 is a side view of the preferred embodiment of the invention according to FIG. 4.
Figure 7:
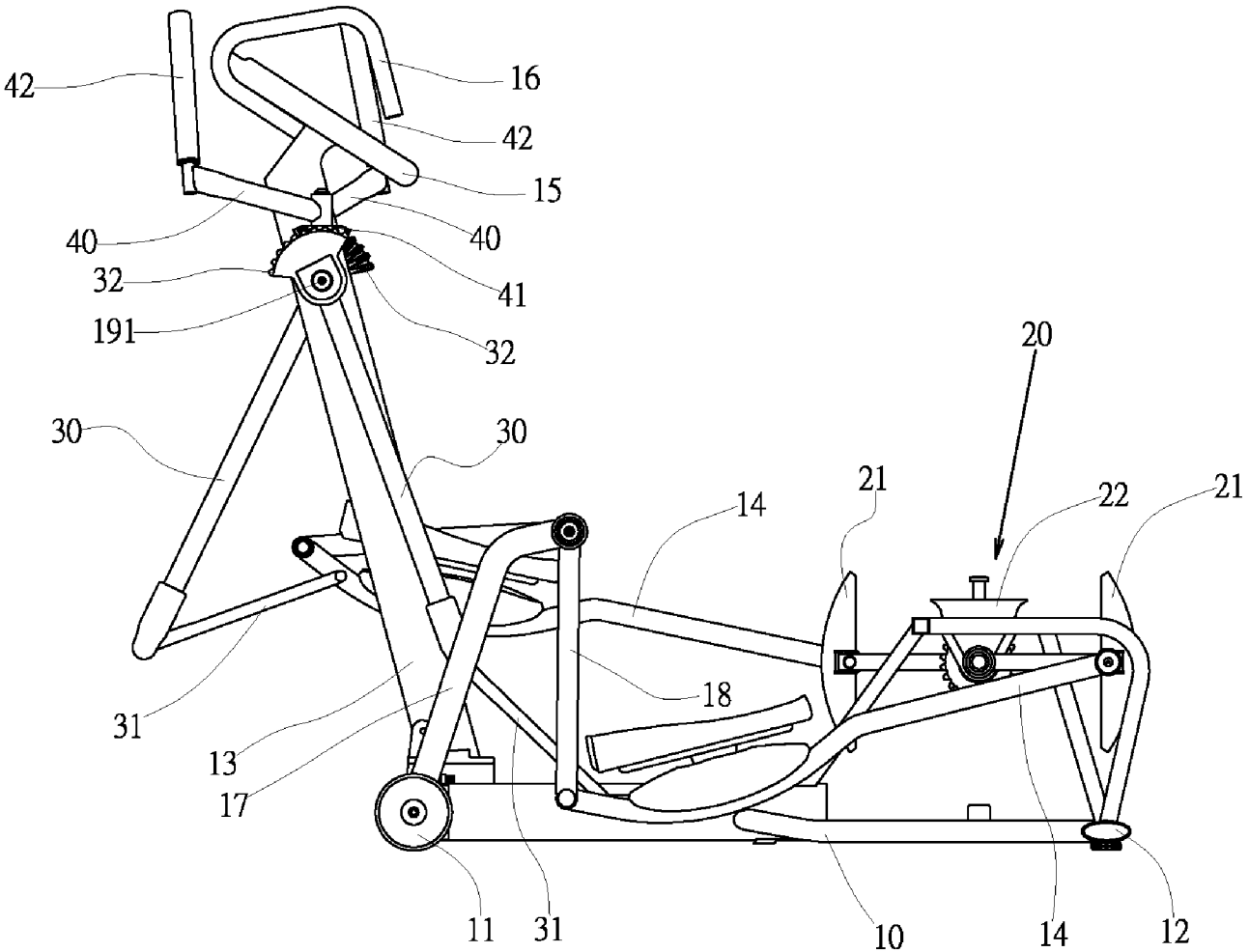
FIG. 7 is a side view of the preferred embodiment of the invention according to FIG. 5.

A preferred embodiment of the invention is shown in FIGS. 1 through 3 that is applied to an elliptical cross trainer. According thereto, the preferred embodiment of the invention includes a base frame 10, a resistance load mechanism 20, two drive rods 30, and two swing handles 40.

The base frame 10 includes a front ground-touching rod 11, a rear ground-touching rod 12, a front support 13, and two pedal rods 14. An electronic console 15 and a fixed type handle unit 16 are provided at the top of the front support 13. The fixed type handle unit is 16 fixed to the front support 13.

The resistance load mechanism 20 includes two swingable load weights 21 and a synchronic drive gear set 22. Moreover, the load weights 21 are pivotally connected to the other end of the pedal rods 14, respectively, such that a coupled relationship is created.

The drive rods 30 are pivotally coupled to the pedal rods 14 through the transmission rods 31 to create a coupled relationship. The other end of the drive rods 30 is pivotally connected to a first cross shaft 191 of the front support 13. A longitudinal drive gear 32 is positioned at the top of the drive rods 30, respectively.

The swing handles 40 are formed in a bent shape and pivotally coupled to a second cross shaft 192 of the front support 13. The swing handles 40 further include a lateral drive gear 41 opposite to the longitudinal drive gear 32 such that a reliable engagement is achieved.

Based on the assembly of the above-mentioned components, as shown in FIGS. 4 through 7, a synchronic movement is achieved when the operator steps on the pedal rods 14 to make a to-and-fro movement or uses his both hands to push the swing handles 40 to swing to the right and left sides. Moreover, the load weights 21 provide a proper exercise resistance and an inertia swing force such that a waist-twisting movement of the upper body can be synchronically achieved when the operator holds the swing handles 40 to take exercise at his feet of the lower body.

The handle 42 of the swing handles 40 may be designed in a pivotally coupled state such that a practical adjustment to the twisting movement of the operator's wrist is ensured and an exercise injury is avoided.

Figure 8:
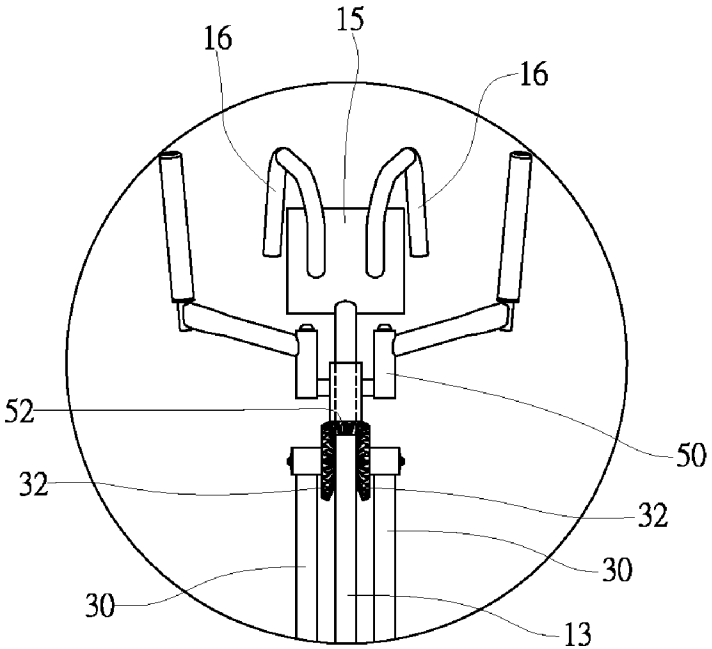
FIG. 8 is a schematic drawing of the partial structure of another embodiment of the invention.

FIG. 8 illustrates another embodiment of the invention. The longitudinal drive gear 32 of the drive rods 30 is cooperated with a single lateral drive gear 52 positioned at the bottom of the swing handles 50. In this way, the same exercise features and effects are achieved, too.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

The invention claimed is:

1. A swing handle arrangement for an exercise equipment, comprising:

a) a base frame having a front ground-touching rod, a rear ground-touching rod, a front support, and two pedal rods, an electronic console and a fixed type handle unit fixed to the front support;

b) a resistance load mechanism having two swingable load weights and a synchronic drive gear set, the load weights being pivotally connected to first ends of the pedal rods, respectively, such that a coupled relationship is created;

c) two drive rods pivotally coupled at first ends thereof to second ends of the pedal rods through transmission rods to create a coupled relationship, second ends of the drive rods being pivotally connected to a first cross shaft of the front support, a longitudinal drive gear being positioned at the top of the drive rods, respectively; and d) two swing handles formed in a bent shape and pivotally coupled to a second cross shaft of the front support, the swing handles further having a lateral drive gear opposite to the longitudinal drive gear such that a reliable engagement is achieved.

2. The swing handle arrangement for an exercise equipment as claimed in claim 1 wherein the swing handles include handles designed in a pivotally coupled state.

3. A swing handle arrangement for an exercise equipment, comprising:

a) a base frame having a front ground-touching rod, a rear ground-touching rod, a front support, two pedal rods, an electronic console and a fixed type handle unit fixed to the front support;

b) a resistance load mechanism having two swingable load weights and a synchronic drive gear set, the load weights being pivotally connected to first ends of the pedal rods, respectively, such that a coupled relationship is created;

c) two drive rods pivotally coupled at first ends thereof to second ends of the pedal rods through transmission rods to create a coupled relationship, second ends of the drive rods being pivotally connected to a first cross shaft of the front support, a longitudinal drive gear being positioned at the top of the drive rods, respectively; and d) a swing handle mounted near the top of the front support, the swing handle further having a lateral drive gear opposite to the longitudinal drive gear such that a reliable engagement is achieved.

4. The swing handle arrangement for an exercise equipment as claimed in claim 3 wherein the swing handle includes a handle designed in a pivotally coupled state.

* * * * *